United States Patent [19]

Russo

[11] Patent Number: 4,501,024

[45] Date of Patent: Feb. 26, 1985

[54] BATHING TRUNKS

[76] Inventor: Peter J. Russo, 719 Nut Plains Rd., Guilford, Conn. 06437

[21] Appl. No.: 558,058

[22] Filed: Dec. 5, 1983

[51] Int. Cl.[3] ..... A41D 5/00

[52] U.S. Cl. ..... 2/67; 2/406

[58] Field of Search ..... 2/67, 238, 400, 402, 2/406, 409

[56] References Cited

U.S. PATENT DOCUMENTS 1,539,659 5/1925 Fitzpatrick ..... 2/238

1,866,220 7/1932 North ..... 2/238

1,962,984 6/1934 Grego ..... 2/67

*Primary Examiner*—Doris L. Troutman

*Attorney, Agent, or Firm*—Walter Spruegel

[57] ABSTRACT

Bathing trunks having substantially triangular front and rear panels joined at the corners, with said front panel being solid throughout, and said rear panel having two cut-outs leaving between them a band-like panel part of a width to cover the cleavage between a wearer's buttocks, and the cut-outs exposing the wearer's buttocks.

5 Claims, 3 Drawing Figures

BATHING TRUNKS

This invention relates to bathing trunks in general, and to bathing trunks for male and female wear in particular.

It is a primary object of the invention to provide a bathing trunks which may be worn by both sexes not only in equally good taste, but even in pleasing harmony with any wearer's sex, be it male or female. To this end, the trunks are tailored for greater exposure of a wearer's body than is afforded by present-day bathing trunks exclusively for male use, whereby the greater body exposure is, on the one hand, borrowed in some measure from the commonly followed custom of thus expressing greater femininity of ladies' bathing suits, as in Bikini shorts, for example, and on the other hand is arranged to express great physical strength and athletic prowess when appearing on male bodies, with the greater body exposure to the elements being also salutary to the wearer's health.

It is another important object of the present invention to provide bathing trunks which for their aforementioned greater body exposure and ensuing adaptation to wear by both sexes in equally good taste merely provide cutouts which are designed to cooperate with outstanding anatomical differences between the male and female sexes in lending the trunks on male and female wearers the aforementioned appearance of enhanced physical strength and athletic prowess and enhanced femininity, respectively.

It is a further important object of the present invention to provide bathing trunks in which the aforementioned cut-outs for adaptation of the trunks to equally tasteful wear by both sexes have the following major characteristics of being restricted to the back of the trunks, being limited in number to two, and being shaped to expose prominent parts of the wearer's buttocks. With these major characteristics of the trunks which are relied on as the sole marks for their adaptation to male and female wear, the trunks remain in front as they always were in front and back, namely plain and without any cut-out or other embelishment, but the back of the trunks is all the more in vast and surprising contrast to their front by the characterized cut-outs that bring into focus prominent parts of a wearer's buttocks which proved to be singularly effective in leaving observors of male and female wearers of the trunks with impressions of superior physical strength and athletic prowess and of superior femininity, respectively. Last, but not least, the cut-outs are tailordered to expose and frame parts of a wearer's buttocks which exhibit characteristic muscle play in action that further enhances the impressive appearance of the trunks, with the cut-outs being to this end roughly triangular in shape so that they will expand in wear into approximate elliptical outline.

Further objects and advantages will appear to those skilled in the art from the following, considered in conjunction with the accompanying drawings.

In the accompanying drawings, in which certain modes of carrying out the present invention are shown for illustrative purposes:

Figure 1:
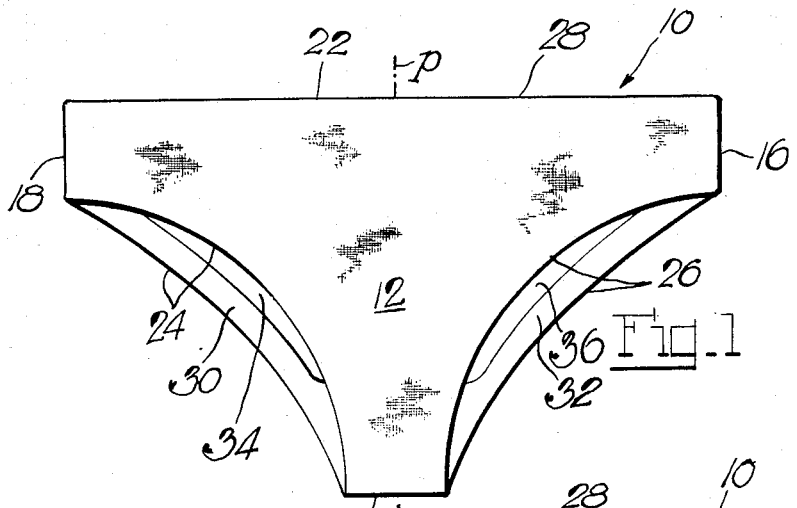
FIG. 1 is a front view of bathing trunks embodying the invention.
Figure 2:
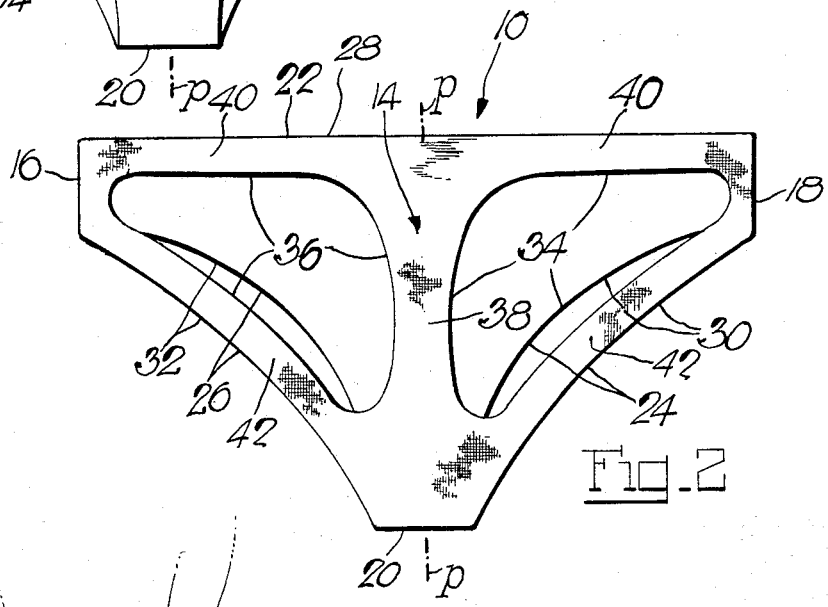
FIG. 2 is a rear view of the same bathing trunks.

Referring to the drawings, and more particularly to FIGS. 1 and 2 thereof, the reference numeral 10 designates bathing trunks having front and rear panels 12 and 14 which are substantially triangular in shape and symmetrical about a median plane p. These front and rear panels 12 and 14 are closed at the corners 16, 18 and 20, and the sides 22, 24 and 26 of these panels between the closed corners 16, 18 and 20 are open and define waist and leg openings 28, 30 and 32. The panels 12 and 14 may be fashioned from woven or knitted fabric in one or more pieces, and may have a hem (not shown) around the waist for forming a tube in which to extend an elastic or non-elastic tie band.

Figure 3:
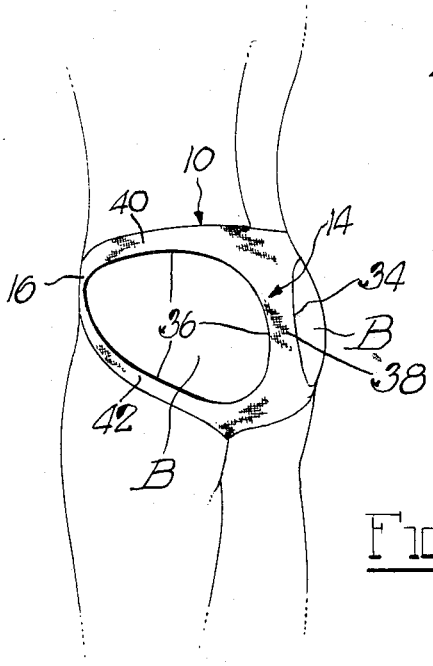
FIG. 3 is a fragmentary perspective view of a male or female wearer of bathing trunks as in FIGS. 1 and 2.

In keeping with the prime objective of the invention, the bathing trunks disclosed in the drawings are marked for wear by both sexes in equally good taste and in pleasing harmony with any wearer's sex, be it male or female. To this end, the trunks are tailored for greater exposure of a wearer's body than is afforded by present-day bathing trunks for male use, whereby the greater body exposure is, on the one hand, borrowed from the commonly followed custom of thus expressing greater femininity of ladies' bathing suits, as in Bikini shorts, for example, and on the other hand, is arranged to express great physical strength and athletic prowess when appearing on male bodies, with the greater body exposure to the elements being also salutary to the wearer's health. For their aforementioned greater body exposure the bathing trunks merely provide cut-outs which are designed to cooperate with outstanding anatomical differences between the male and frmale sexes in lending the trunks the aforementioned enhanced physical strength and athletic prowess and enhanced femininity, respectfully. To this end, the cut-outs in the bathing trunks have the following major characteristics of being restricted to the back or rear panel 14 of the trunks (FIGS. 2 and 3), being limited in number to two cut-outs 34 and 36, and being shaped to expose prominent parts of the wearer's buttocks B (FIG. 3). With these major characteristics of the trunks, the same remain in front as they always were in front and back, namely plain and without any cut-out or other embellishment, but the back of the trunks is all the more in vast and surprising contrast to their front by the characterized cut-outs that bring into focus prominent parts of a wearer's buttocks which proved to be singularly effective in leaving observers of male and female wearers of the trunks with impressions of superior physical strength and athletic prowess and of superior femininity, respectively. Last but not least, the cut-outs are tailored to expose and frame parts of a wearer's buttocks which exhibit characteristic muscle play in action that further enhances the impressive appearance of the trunks, with the cut-outs being to this end roughly triangular in shape so that they will expand in wear into approximate elliptical outline.

Further characteristic of the cut-outs 34 and 36 in the back of the trunks are their spacing from each other to leave between thema band-like panel part 38 of adequate width to cover the cleavage between a wearer's buttocks. Still further, the cut-outs 34 and 36 are of sufficiently large size to leave in back of the trunks along the waist and leg openings 28,30 and 32 other band-like panel parts 40 and 42 which are of no greater width, and preferably of smaller width, than the middle band-like panel part 38.

What is claimed is:

1. Bathing trunks having a median plane and superposed substantially triangular front and rear panels symmetrical about said plane and joined at the corners, with the adjacent sides of the panels between the joined corners being non-joined to form waist and leg openings, and said rear panel having two cut-outs symmetrical about said plane and leaving between them a first band-like panel part of a width to cover the cleavage between a wearer's buttocks, with said cut-outs exposing a wearer's buttocks.

2. Bathing trunks as in claim 1, in which said cut-outs are of sufficiently large size to leave in said rear panel along said waist and leg openings other band-like panel parts of no greater width than that of said first band-like panel part.

3. Bathing trunks as in claim 2, in which said other band-like panel parts are of smaller width than that of said first band-like panel part.

4. Bathing trunks as in claim 1, in which each of said cut-outs is of substantially triangular shape, with the band-like panel part along the associated leg opening being the longest part of the triangle.

5. Bathing trunks as in claim 4, in which the corners of said substantially triangular shape of each cut-out are rounded at sufficiently large radii to have a wearer's buttocks deform the cut-out into an egg-like shape.

* * * * *